United States Patent [19]

Uemura et al.

[11] Patent Number: 4,978,294

[45] Date of Patent: Dec. 18, 1990

[54] EXTERNAL HEATING ROTARY FURNACE

[75] Inventors: Tadashi Uemura, Tokuyama; Shirou Hayashi, Ibaraki, both of Japan

[73] Assignees: Tosera Engineering Co., Ltd., Aichi; Showa Denko Kabushiki Kaisha; Shunan Denko Kabushiki Kaisha, both of Tokyo, all of Japan

[21] Appl. No.: 381,703

[22] PCT Filed: Sep. 1, 1988

[86] PCT No.: PCT/JP88/00878

§ 371 Date: Apr. 26, 1989

§ 102(e) Date: Apr. 26, 1989

[87] PCT Pub. No.: WO89/02057

PCT Pub. Date: Mar. 9, 1989

[30] Foreign Application Priority Data

Sep. 3, 1987 [JP] Japan ..... 62-219232

[51] Int. Cl.[5] ..... F27B 7/00

[52] U.S. Cl. ..... 432/103; 432/107; 432/113; 432/119

[58] Field of Search ..... 432/103, 105, 107, 109, 432/112–114, 119

[56] References Cited

U.S. PATENT DOCUMENTS

| | | | |
|---|---|---|---|
| 2,071,534 | 2/1937 | Ingraham | 432/113 |
| 2,131,665 | 9/1938 | Jordan | 432/113 |
| 2,230,141 | 1/1941 | Heuer | 432/103 |
| 2,348,673 | 5/1944 | Degner | 432/113 |
| 2,869,849 | 1/1959 | Folliot et al. | 432/119 |
| 3,169,016 | 2/1965 | Wicken et al. | 432/119 |
| 3,430,936 | 3/1969 | Metzger | 432/107 |

FOREIGN PATENT DOCUMENTS

| | | |
|---|---|---|
| 1257685 | 12/1967 | Fed. Rep. of Germany . |
| 700633 | 3/1931 | France . |

*Primary Examiner*—Henry C. Yuen

*Attorney, Agent, or Firm*—Sughrue, Mion, Zinn, Macpeak & Seas

[57] ABSTRACT

This invention aims to offer an external heating rotary furnace for indirectly heating materials such as ore, coke, etc. which are liable to be oxidized, by insulating then from an oxidixing combustion gas atmosphere. The furnace comprises the following members: are reaction chamber (5) in which materials are heated to high temperature, defined by heat resistant ceramic means 4 from the combustion chamber (10) in which the fuel burns out.

The fuel burns out in the combusion chamber, and combustion gas does not pass through the reaction chamber (5). Materials to be treated are heated indirectly in the reaction chamber (5) through the insulating ceramic wall (4).

According to this invention, materials to be treated can be heated indirectly over 1,400° C. effectively isolated from the combustion gas atmosphere, and inexpensive fuel can be used. Particularly, this invention is useful for the reduction of ores. By utilizing a rotary furnace according to the invention, inexpensive fuel can be used in getting high temperature admitting gas admitting into the heating gas chamber (6).

1 Claim, 5 Drawing Sheets

EXTERNAL HEATING ROTARY FURNACE

BACKGROUND OF THE INVENTION

1. Field of the invention

The present invention relates to rotary furnace for indirectly heating materials by utilizing combustion gas of fuel.

2. Description of the related art

One of the most efficient and economical methods for heating powder or granular materials is burning fuel generate high temperature gas and the subjecting the materials to heat exchange with this gas. The combustion gas may include gaseous components which are capable of reacting with the materials at high temperature. In this case, the above method cannot be utilized for heating, not withstanding the efficiency. In order for heating the materials which are capable of reacting with the combustion gas, electricity must be used as a heat source instead of fuel, or in another case, inert gas must be introduced in a furnace. As a result, economy of heating is disadvantageously impaired.

The oxidizing gaseous components, such as oxygen, carbon dioxide, hydrogen oxide and sulfur trioxide, are contained in the combustion gas of fuel.

When ore is heated under such as oxidizing atmosphere to reduce the same, ore is liable to be exposed to such oxidizing atmosphere. This is the very reverse of what is intended by heating. The reducing method of ore by heating it in a rotary kiln by means of combustion gas of the fuels, such as coal, heavy oil and LPG, is broadly used for smelting, since inexpensive energy can be use, and further, continuous treatment by mass production is possible. However, the combustion gas includes, as described hereinabove, oxidizing gaseous components, such as exessive oxygen, carbon dioxide, hydrogen oxide and sulfur trioxide, with the result that the atomosphere of combustion gas is not the objective reducing one but is the oxidizing one, which is unsatisfactory in the light of the increasing reduction degree.

To isolate the materials to be reduced from the oxidizing atmosphere combustion gas, it is known to enclose the combustion flame in a ceramic tube in order to heat the materials indirectly through the ceramic tubes by utilizing radiation and conduction of the heat. For example, U.S. Pat. No. 1,871,848 discloses an isolation method (CF. FIG. 3) mentioned above.

Another method for isolating the materials to be reduced from the oxidizing atmosphere of combustion gas, is to apply a coating layer on the surface of the materials to be reduced. In this case, the materials are substantially heated in unoxidizing atmosphere. Such a method is disclosed in the U.S. Pat. No. 3,153,586.

The method disclosed in the U.S. Pat. No. 1,871,848 mentioned above involves a problem that mechanical strength of the ceramic tube is decreased at high temperature. It is difficult to manufacture pipes having a large diameter and length. The highest temperature at which the furnace disclosed in above-mentioned U.S. Pat. No. 1,871,848 operates is 1,000° C. at the highest. Iron ore is only one ore that can be reduced at this temperature. The greatest length of pipe that can be manufactured is 2~3 m at the most. It is impossible to entirely surround the combustion flame by such as pipe, and hence to effectively isolate by such a pipe the materials to be reduced from the combustion gas of fuel. Such method as disclosed in the above-mentioned patent is therefore not appropriate for reducing ore which contains, such metal as chromium, having high affinity with oxygen, and which is liable to be influenced by the atmosphere of combustion gas.

It is an object of the present invention to improve a rotary furnace constitution having high treating capacity, and having an ability that materials to be treated are effectively isolated from the combustion gas of fuel.

DISCLOSURE OF THE INVENTION

In accordance with the object of the present invention, there is provided an external type rotary furnace comprising a rotary furnace body which includes the following rotary members capable of rotating therewith and being integral therewith: a reaction chamber located at the center of the rotary furnace body and consisting of polygons in cross section made of heat resistant ceramics; and a plurality heating gas chambers formed around the reaction chamber.

According to such a constitution, the fuel burns up in the combustion chamber to generate high temperature, and to heat the ceramic plates. The materials to be treated in the reaction chamber are heated in substantially unoxidizing atmosphere without any influences of oxidizing gasous components in combustion gas, such as exessive oxygen, hydrogen oxide, carbon dioxide and sulfur trioxide, so that the reducing reaction are improved remarkably.

First, in this invention, combustion chamber of the fuel are separated by ceramic plates from the reaction chamber, in which the raw materials to be treated are contained.

The present invention is described in detail with reference to the embodiments illustrated in the drawings.

Referring to FIG. 1, an embodiment of the external heating type rotary furnace according to the present invention is shown by the vertical cross section with respect to a rotary axis. Referring to FIG. 2, the identical furnace is shown by the cross section parallel to the rotary axis.

Referring to FIG. 1, heat insulative bricks 2 are lined around the inner surface of the steel mantle 1. The height of the heat insulative bricks 2 is not uniform around the steel mantle 1, but the taller supporting bricks 3 are located at an appropriate distance between them (each seven bricks in the embodiment shown FIG. 1). The supporting bricks 3 support the ceramic plates 4, which are the partition walls of the heating gas chambers 6. A reaction chamber 5 having polygonal form in cross section is therefor surrounded and defined by the ceramic plates 4 and supporting brick 3. In addition, a plural of heating gas chambers 6 are formed around the reaction chamber 5, defined by the heat insulative bricks 2, supporting bricks 3 and ceramic plates 4. Since the reaction chamber 5 and heating gas chamber 6 are constructed above, when the steel mantle 1 is rotated, they (5 and 6) are rotated integrally with the rotation of the steel mantle 1. While the furnace is rotated, materials to be treated in the reacting chambers 5 are stirred and are simultaneously heated by radiation and conduction through the ceramic plates 4. The materials are therefore heated while they are isolated froom the combustion gas atmosphere of fuel.

Referring to FIG. 2, a combustion furnace 22 has a plurality of burner 11. High temperature gas obtained in each combustion chamber 10 is passed through the heating gas chambers 6 of the rotary furnace body 20, which is opposite to the combustion chamber 10. The high temperature gas heats the ceramic plates 4 of the partition walls while passing through the heating gas chamber 6, and is then collected through a exhaust gas port 14 to the exhaust gas chamber 9, followed by exhausting outside of the heating system through an exhaust gas outlet 13.

Meanwhile, materials to be treated are fed through the supplying port of raw materials 15 to the reaction chamber 5 and are then subjected to rotary traveling in the reaction chamber 5, while being indirectly heated by combustion gas which is isolated from the materials. Materials are then withdrawn as the product from the reacting chamber 5 through the product outlet 16 provided on the lower part of the combustion furnace 22. The product is then collected with a chute 17 and withdrawn.

The rotary furnace body 20 is supported by rollers 8 via supporting rings 7 and is driven by a power source (not shown) to rotate. The combustion furnace 22 and panel 21 are connected with the rotary furnace body 20 to form an integral structure. Namely, the rotary furnace body 20, combustion furnace 22, and panel 21, as a whole, constitute an integrally rotary furnace body. Pipings for feeding fuel and air are connected to the burners 11 via universal joints. The burners 11 are rotated together with the rotation of the rotary furnace body 20.

Exhausting gas chamber 18 is provided around the rotary furnace body 20, and settled down to the bases. Exhausting gas is collected with exhausting chamber 18, and is exhausted out from the gas outlet 19. Another exhausting gas chamber 9 provided opposite side of the burner has the same constitution.

For the heat insulative brick 2, bricks having a low heat conductivity are used so as to attain the smallest external dissipation of heat through the steel mantle. Practically, heat conductivity ($\lambda$) of heat insulative brick 2 is from 0.10 to 2.0 kcal/m.h. °C. (1,000° C.), preferably from 0.1 to 0.5 kcal/m.h. °C. Heat insulative bricks 2 may be porous, e.g. having porosity ranging from 60 to 70%. The heat insulative bricks 2 may be constructed in dual layers.

Since the supporting bricks 3 are used to support the ceramic polygons, high strength bricks should be used, even at the sacrifice of slight thermal conductivity. Preferred bricks for the supporting bricks are those based on chamotte and alumina. Brickwork of the heat insulative bricks 2 may be performed with the use of castable refractory.

The ceramics which form the polygon should have strength withstanding at a high temperature of 1,400° C. or more and a high heat conductivity, and should not be attached by combustion gas at a high temperature. Materials satisfying these requirements are ceramics, such as silicon carbide, aluminum nitride, alumina, and the like. Silicon carbide is particularly preferred, since large size sintering products are available.

Sintering silicon carbide exhibits a heat conductivity of 10 kcal/m.h. °C. or more (at 1,000° C.), compression strength (bending strength) of 200 kg/cm$^2$ or more (at 1300° C.), and belong to materials having high strength and high heat conductivity. Such stregth is satisfactory for supporting the load of the charged materials, when exposed to combustion gas atmosphere.

According to the present invention, the heating gas chamber 6 is located in outer circumference of rotary furnace body 20 and is used for both the combustion chamber and chimney. To heat materials, the reaction chamber 5 is positioned at the center of the rotary furnace body 20. The partition walls defining the reaction chamber 5 are in the form of a polygon in cross section, at the respective apexes of which the supporting bricks 3 for the ceramic plates 4 are located. The member for defining the heating gas chamber 6 is very much simplified construct, in the case the plates are used. Detailed brickwork of the rotary furnace is shown in FIG. 3. The supporting bricks 3 have, on the top, a projection 3*a*, so that two side tracks 3*b* are formed besides the projection. Ceramic plates 4 are rigidly inserted along the side tracks 3*b*.

Referring to FIG. 1, hexahedron in cross section by ceramic plates are used as a reaction chamber. The form of a polygon in cross section may not be defined by this embodiment, but may be an octahedron or dodecahedron. The plates for defining the heating gas chamber 6 may be straight, but also but may be curved. These embodiments are illustrated in FIG. 4~FIG. 7.

Referring to FIG. 4 and FIG. 5, several embodiments of the partition walls are illustrated. In FIG. 4 and FIG. 5, the heating gas chamber 6 are constructed with square blocks 4.

In FIG. 6, the heating gas chamber 6 are constructed with the blocks 4 in the form of " ". In FIG. 7, the heating gas chamber 6 is constructed with cylindrical blocks. The reaction chamber 5 may be defined by curves, and have a round configuration as in FIG. 7.

As is described hereinabove, according to the present invention, the reaction chamber 5 and heating gas chambers 6 are located at the center and circumferential part of the rotary furnace respectively. The former and the latter are isolated from each other by the ceramic partition walls. Combustion heat, which may be obtained by utilizing inexpensive fuel, is transmitted through ceramic partition wall to materials to be treated, which therefore do not undergo chemical influence of combustion gas stream at all.

By utilizing a rotary furnace according to the present invention, inexpensive fuel can be used for getting high temperature gas of from 1,600° to 1,800° C. admitted into the heating gas chambers. In this case, the temperature in the reaction chamber 5 can be elevated at 1,500° C. or more, and the temperature of materials indirectly heated can be elevated to 1,400° C. or higher. By utilizing such a rotary furnace as described above, chromium ore pellets, in which coke is mixed as carbonaceous reductant, can be reduced at a reduction degree of 95% or more, while excluding no influence of oxidizing combustion gas. In the case where a traditional direct fired heating method is used for the reduction of chromium ore, a reduction degree is approximately 80% maximum.

The present invention is applicable to heating and treating methods in which a chemical influence of combustion gas is to be excluded, such as coke-conversion of coal, high temperature firing of alumina, silicon carbide, zirconium oxide, and the like, high temperature dry plating, and the like. The present invention is particularly advantageous for mass treatment.

INDUSTRIAL APPLICABILITY

A rotary furnace according to this invention is useful for treatments in which oxidizing reactions should be avoided. For example, it is reliable for the equipment to reduce chromium ore pellets containing carbonaceous reductant, to reduce iron ore and to carbonize coal.

BRIEF DESCRIPTION OF THE DRAWINGS

FIG. 1 is a cross sectional view of furnace according to an embodiment of the present invention, and FIG. 2 is a cross sectional view along the rotary axis of the same.

DESCRIPTION OF THE PREFERRED EMBODIMENT

Figure 1:
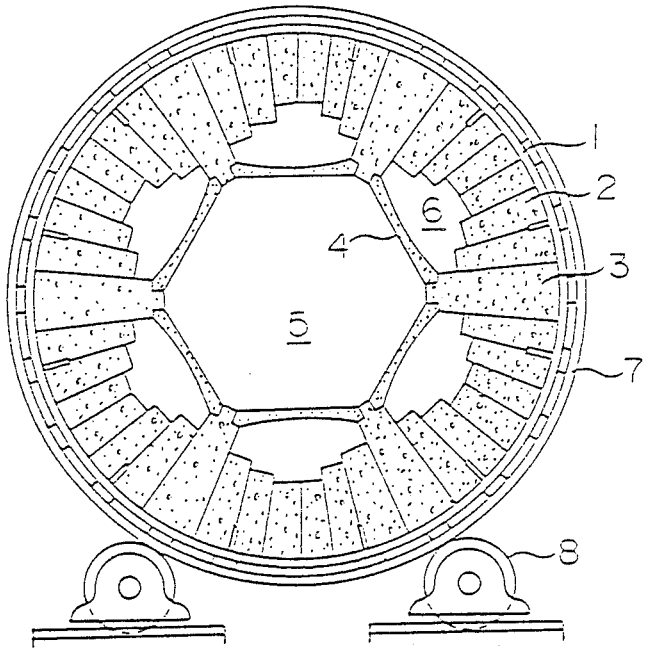
FIG. 1 and FIG. 2 illustrative the construction of the external heating rotary furnace according to this invention.
Figure 2:
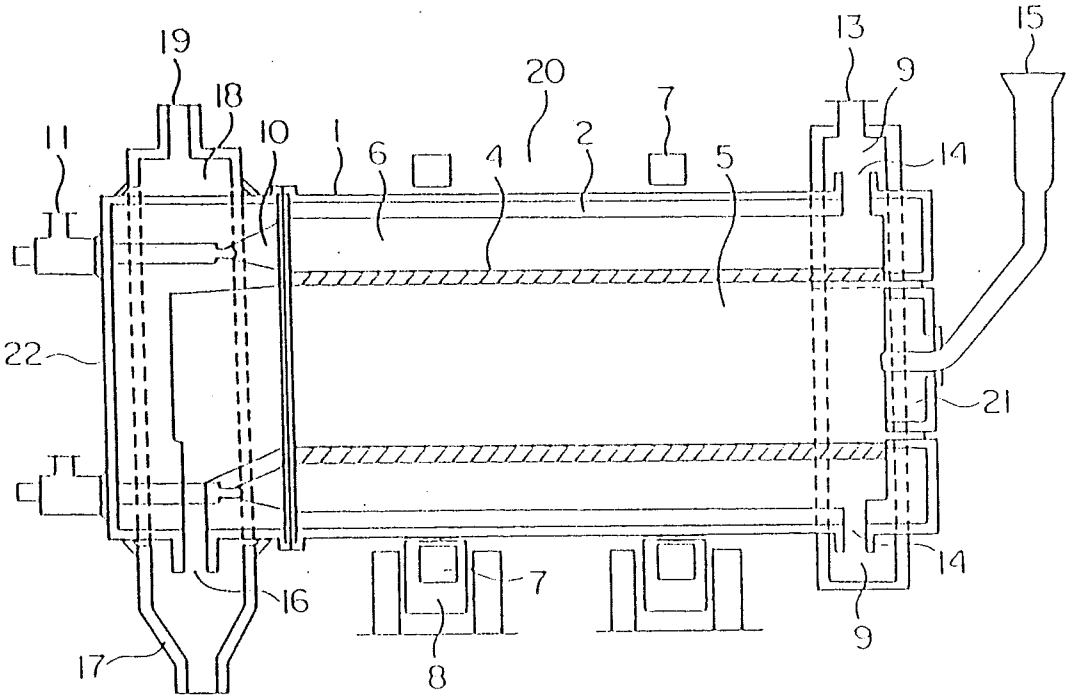

Referring to FIG. 1, an embodiment of the external heating type rotary furnace according to the present invention is shown by the vertical cross section with respect to a rotary axis. Referring to FIG. 2, an identical furnace is shown by the cross section parallel to the rotary axis. Referring to FIG. 1, heat insulative bricks 2 are lined around the inner surface of the steel mantle 1. The height of the heat insulative bricks 2 is not uniform around the steel mantle 1, but the taller supporting bricks 3 are located at an appropriate distance between them, e.g., each seven briks in the embodiment as shown in FIG. 1. The supporting bricks 3 support the ceramic plate 4 which are the partition walls. A reaction chamber 5 having polygonal form in cross section is therefor surrounded and defined by the ceramic plates 4 and supporting brick 3. In addition, a plural of heating gas chambers 6 are formed around the reaction chamber 5, defined by the heat insulative bricks 2, supporting bricks 3 and ceramic plate 4. Since the reaction chamber 5 and heat gas chamber 6 are constructed as above, when the steel mantle 1 is rotated, they (5 and 6) are rotated integrally with the rotation of the steel mantle 1. While the furnace is rotated, materials to be treated in the reaction chambers 5 are stirred and are simultaneously heated by radiation and conduction through the ceramic plates 4. The materials are therefore heated while they are isolated from the combustion gas atmosphere of the fuel.

Referring to FIG. 2, a combustion furnace 22 has a plurality of burner 11. High temperature gas obtained in each combustion chamber 10 is passed through the heating gas chambers 6 of the rotary furnace body 20, which is opposite to the combustion chamber 10. The high temperature gas heats the ceramic plates 4 of the partition walls while passing through the heating gas chamber 6, and is then collected through an exhaust gas port 14 to the exhaust gas chamber 9, followed by exhausting outside of the heating system through an exhaust gas outlet 13. Meanwhile, materials to be treated are fed through the supplying port of raw materials 15 to the reaction chamber 5 and is then subjected to rotary traveling in the reaction chamber 5, while being indirectly heated by combustion gas which is isolated from the materials. Materials are then withdrawn, as the product, from the reaction chamber 5 through the product outlet 16 provided at the lower part of the combustion furnace 22. The product is then collected with a chute 17 and withdrawn.

The rotary furnace body 20 is supported by rollers 8 via supporting rings 7 and is driven by a power source (not shown) to rotate. The combustion furnace 22 and panels 21 are connected with the rotary furnace body 20 to form an integral structure. Namely, the rotary furnace body 20, combustion furnace 22 and panels 21, as a whole, constitute an integrally rotary furnace body. Pipings for feeding fuel and air are connected to the burners 11 via universal joints. The burners 11 are rotated together with the rotation of the rotary furnace body 20.

For the heat insulative brick 2, bricks having a low heat conductivity are used so as to attain the smallest external dissipation of heat through the steel mantle. In this embodiment, chamotte brick is used as heat insulative brick, of which heat conductivity ($\lambda$) is 0.16 kcal/m.h. °C.

Since the supporting bricks 3 are used for support the ceramic polygonal, high strength brick should be used, even at the sacrifice of slight thermal conductivity. In this embodiment, hihg-alumina brick is used as supporting brick, having a heat conductivity of 0.02 kcal/m.h. °C., compression strength of 2,368 kg/cm$^2$, and a bending strength of 240 kg/cm$^2$.

Next, the ceramic which forms the polygon should have strength withstanding at a high temperature of 1,400° C. or more, and a high heat conductivity, and should not be attacked by combustion gas at a high temperature. In this embodiment, sintering silicon carbide is used, with a heat conductivity of 10 kcal/m.h. °C. or more (at 1,000° C.), and a bending strength of 200 kg/cm$^2$ or more (at 1,300° C.), so that a material is used that has high strength and high heat conductivity. Such strength is satisfactory for supporting the load of the charged materials, when exposed to combustion gas atmosphere.

Figure 3:
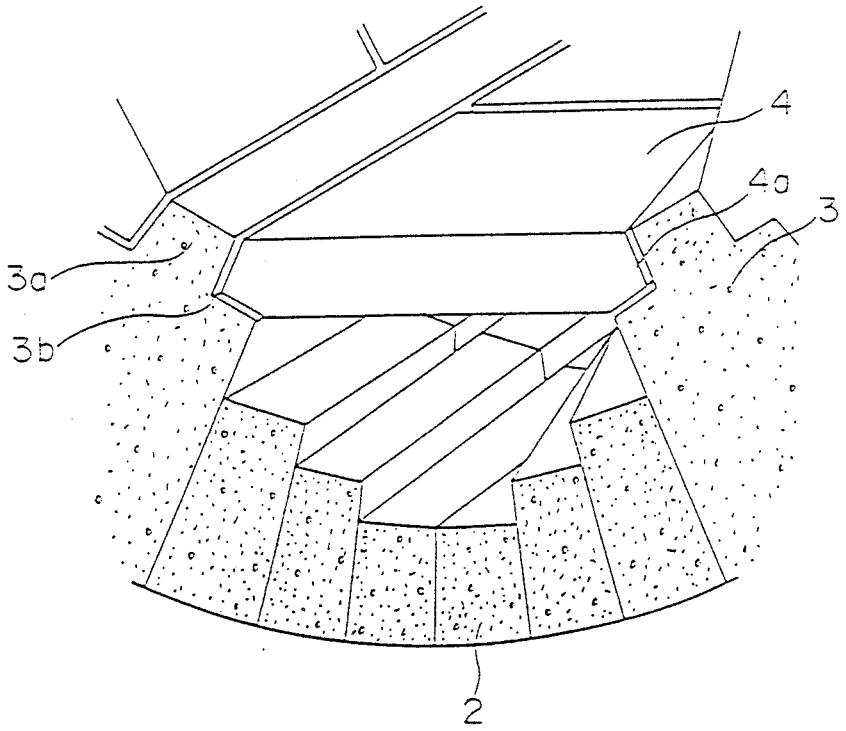
FIG. 3 illustrates a method of block work for manufacturing a furnace according to the present invention.

According to the present invention, the heating gas chamber 6 is located in the outer circumference of rotary furnace body 20 and is used for both the combustion chamber and chimney. The reaction chamber 5 to heat materials is positioned at the center of the rotary furnace body 20. The partition walls defining the reaction chamber 5 are in the form of a polygon in cross section, at the respective apexes of which the supporting bricks 3 for the ceramic plates 4 are located. Brickwork is more simplified, in the case plates are used as the partion wall. Detailed brickwork of the rotary furnace is shown in FIG. 3. The supporting bricks 3 have, on the top, a projection 3*a*, so that two side tracks 3*b* are formed besides the projection. Ceramic plates 4 are rigidly inserted along the side tracks.

With regard to setting of ceramic plates, it is preferable to give appropriate angle to the side tracks 3*b* of the supporting bricks and the side tracks 4*a* of the ceramic plates, to prevent the plates from taking off while their rotating. Referring to FIG. 1, hexahedrons in cross section formed by ceramic plates are used as a reaction chamber. The form of a polygon in cross section may not be defined by this embodiment but may be octahedron, dodecahedron or curred.

Figure 4:
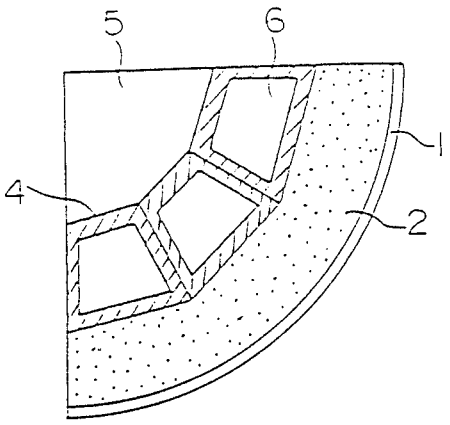
FIG. 4~FIG. 7 are partial cross sectional view of another embodiment of the present invention.
Figure 5:
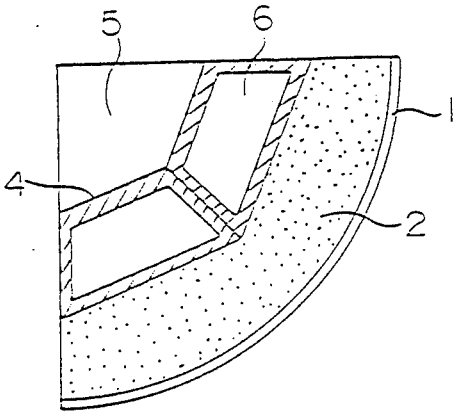
Figure 6:
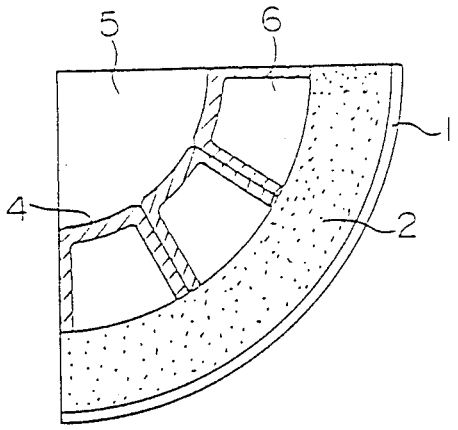
Figure 7:
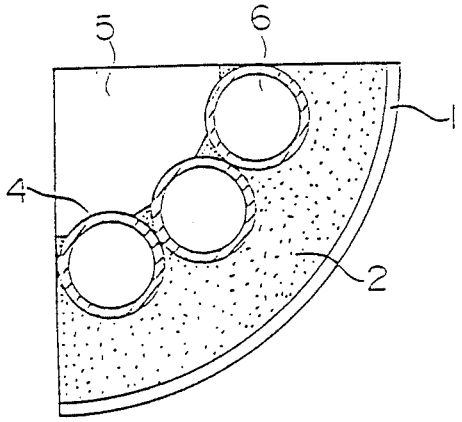

Referring to FIG. 4~FIG. 7, several embodiments of the partition wall are illustrated. In FIG. 4 and FIG. 5, the heating gas chambers 6 are constructed with square blocks 4. In FIG. 6, the heatig gas chamber 6 are constructed with the blocks in the form "  ". In FIG. 7, the heating gas chambers 6 are constituted with cylindrical bricks. The reaction chamber 5 may be defined by curves as in FIG. 7.

What is claimed is:

1. An external heating rotary furnace comprising following rotary members capable of rotating therewith and being integral therewith:

(a) supporting bricks (3) which support ceramic plates 4 and are lined around a inner surface of the steel mantle (1), the height of which is not uniform around the steel mantle but higher than another at an appropriate distance between them, (b) reaction chamber (5), which is located at the center of the rotary furnace body (20), and defined by polygons made of heat resistant ceramic plates (4) supported by a supporting bricks (3), and heat insulating bricks (2), (c) plurality of heatig gas chambers (6) which are each formed around the reaction chamber (5) by the heat insulative brick (2), supporting brick (3) and ceramic insulating plate (4), (d) burner (11) provided at the each end of the heating gas chamber (6).

* * * * *